United States Patent [19]

Nakamura et al.

[11] Patent Number: 4,773,876

[45] Date of Patent: Sep. 27, 1988

[54] MULTI-CONDUCTOR FLAT CABLE ELECTRICAL CONNECTOR AND TERMINATION METHOD THERETO

[75] Inventors: Mitsuo Nakamura; Keiji Soma, both of Tokyo, Japan

[73] Assignee: Hirose Electric Co., Ltd., Tokyo, Japan

[21] Appl. No.: 46,551

[22] Filed: May 6, 1987

[30] Foreign Application Priority Data

Jun. 2, 1986 [JP] Japan ..... 61-127656
Jun. 11, 1986 [JP] Japan ..... 61-135129

[51] Int. Cl.[4] ..... H01R 4/24
[52] U.S. Cl. ..... 439/417
[58] Field of Search ..... 439/395–404, 439/417–419

[56] References Cited

U.S. PATENT DOCUMENTS

| | | | |
|---|---|---|---|
| 4,143,935 | 3/1979 | Goodman et al. | 339/99 R |
| 4,195,893 | 4/1980 | Stupay | 339/14 R |
| 4,209,219 | 6/1980 | Proietto | 339/99 R |
| 4,260,209 | 4/1981 | Zell et al. | 339/14 R |
| 4,367,004 | 1/1983 | Fajura et al. | 439/396 |
| 4,582,378 | 4/1986 | Fruchard | 339/45 M |
| 4,669,800 | 6/1987 | Reich | 439/399 |

*Primary Examiner*—Joseph H. McGlynn
*Attorney, Agent, or Firm*—Takeuchi Patent Office

[57] ABSTRACT

A multi-conductor flat cable electrical connector, which comprises a plurality of terminals each having a contacting part for contact with the contacting part of a mating connector and a pressure welding part to be connected to a conductor of a multi-conductor flat cable; an insulating housing for holding said terminals in such a manner that said pressure welding parts may project therefrom; a termination member having a conductor holding recess for an end of said flat cable and adapted to be united to said insulating housing; said terminals being arranged in said insulating housing so that said pressure welding parts may be aligned in at least two pairs of lines; said pressure welding parts being arranged alternately in each of said pairs of lines at a pitch twice that of said conductors so that the pitch between said adjacent terminals may be equal to that of said conductors; said termination member having a pair of conductor arranging recesses extending laterally to either side from said holding recess and a plurality of pressure welding part receiving recesses; and said termination member and said insulating housing being united so that said respective conductors are press welded to said respective pressure welding parts.

23 Claims, 11 Drawing Sheets

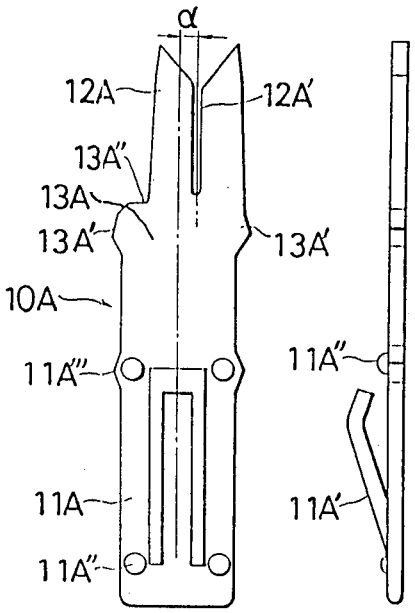
FIG. 2 A
FIG. 2 B
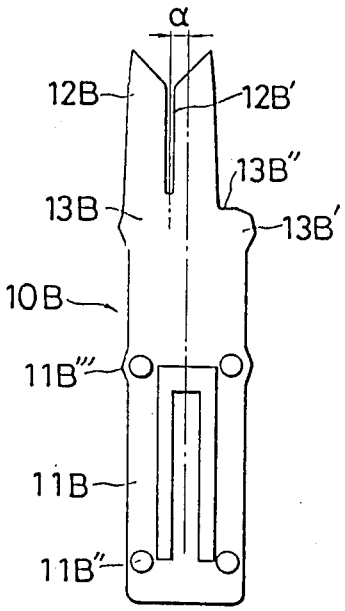
FIG. 3 A
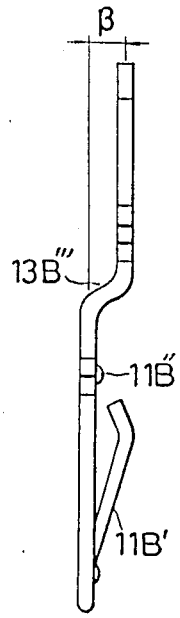
FIG. 3 B
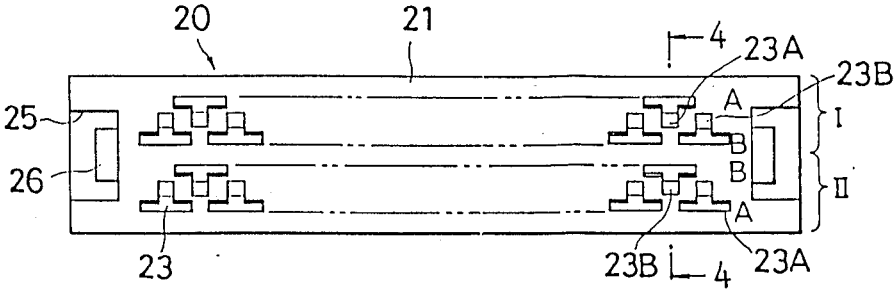
FIG. 4
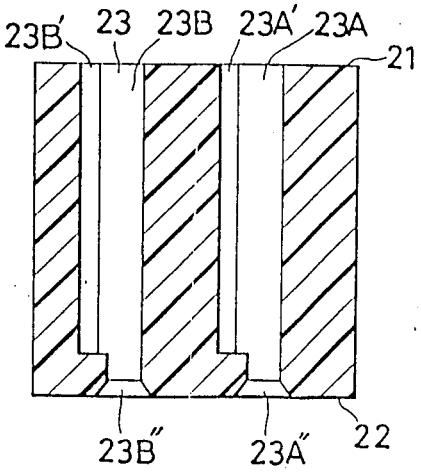
FIG. 5

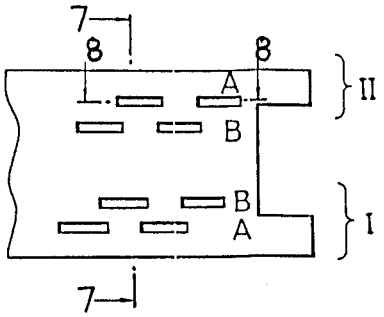
FIG. 6
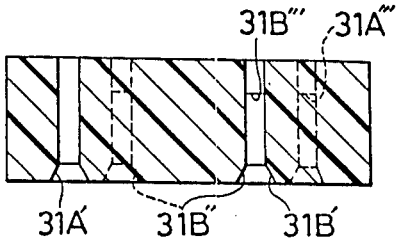
FIG. 7
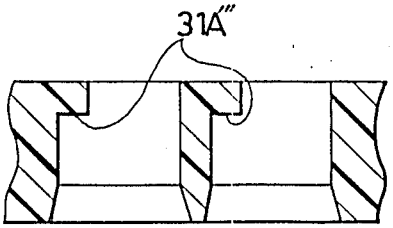
FIG. 8
FIG. 9 A
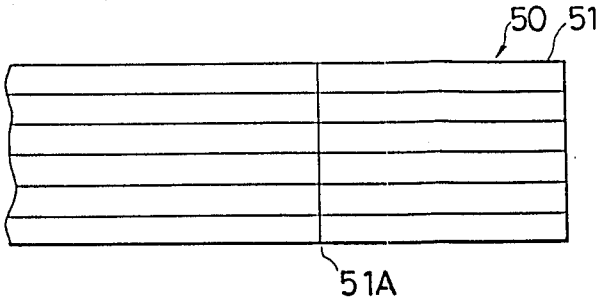
FIG. 9 B
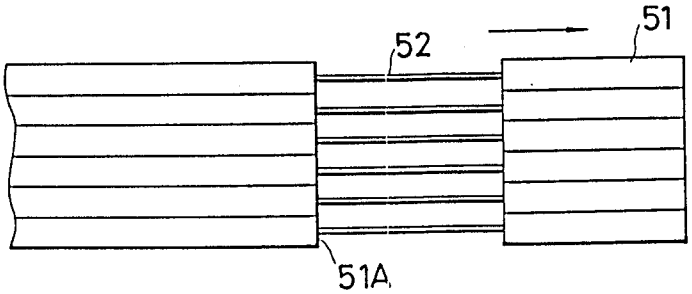
FIG. 9 C
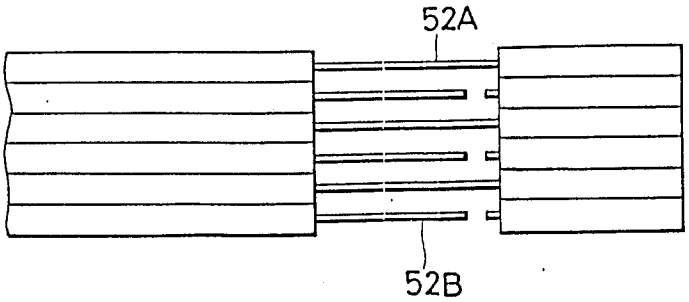

FIG. 21
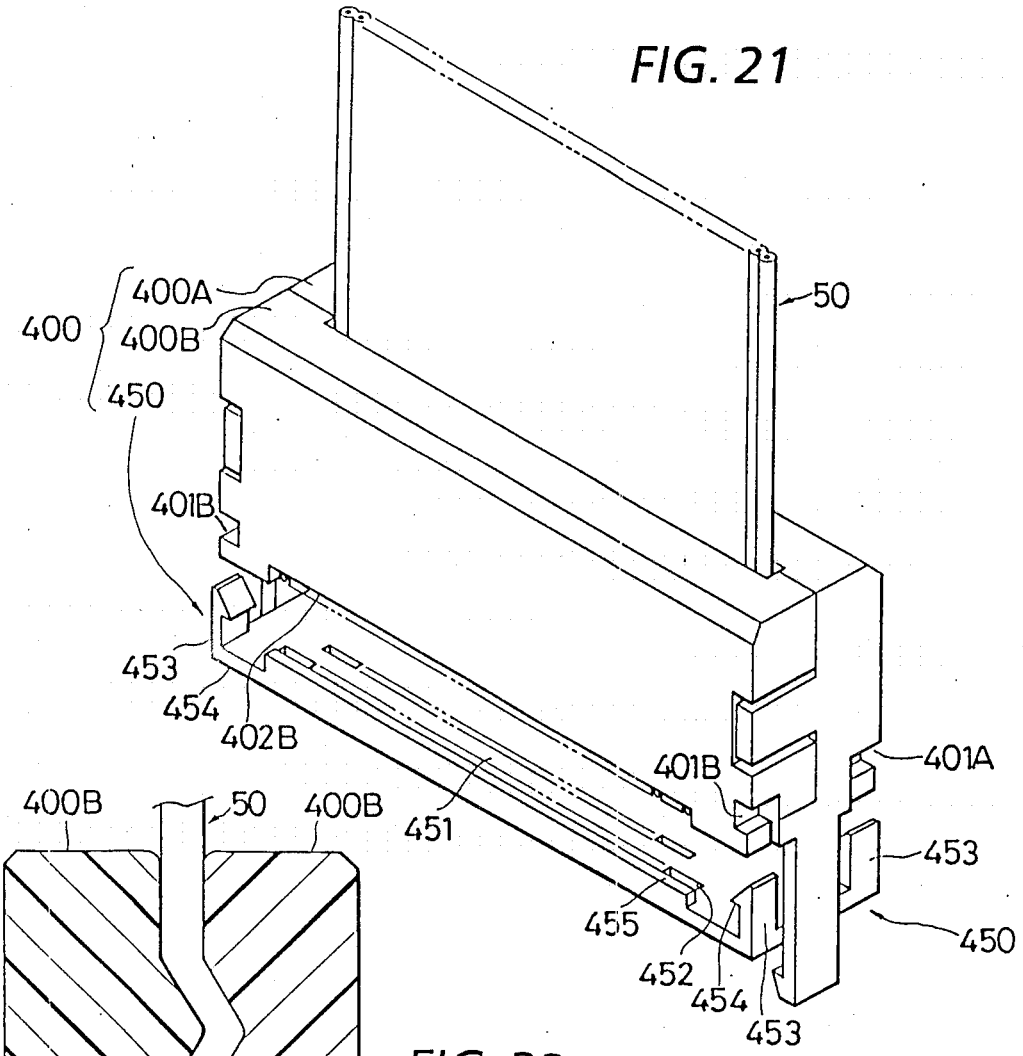
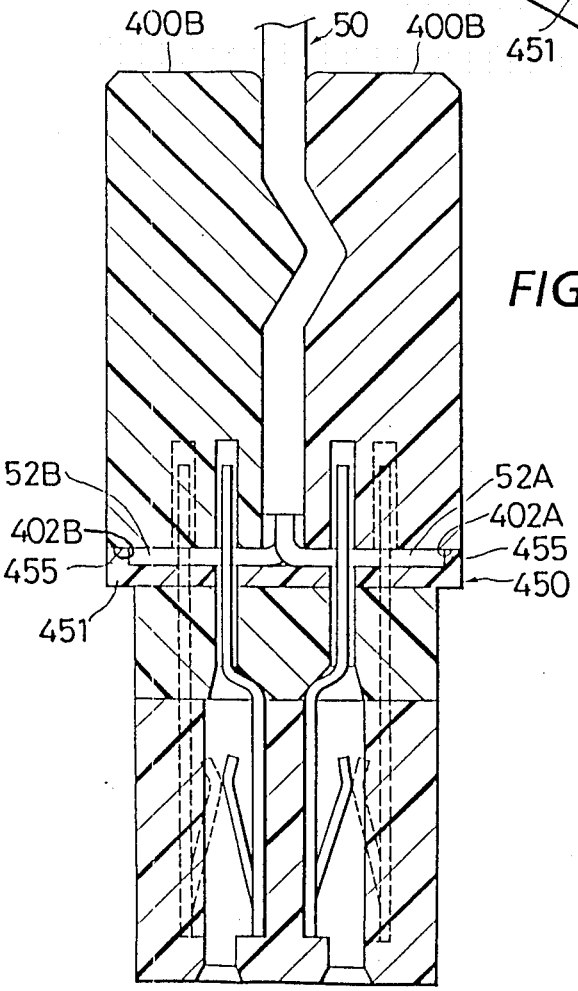
FIG. 22
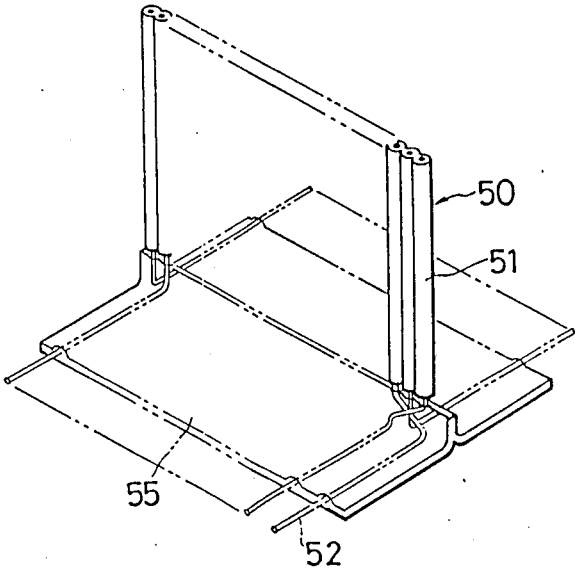
FIG. 20

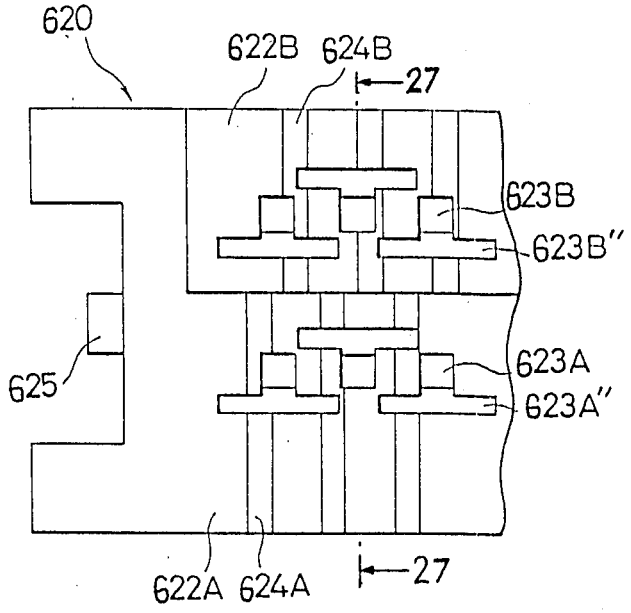
FIG. 26
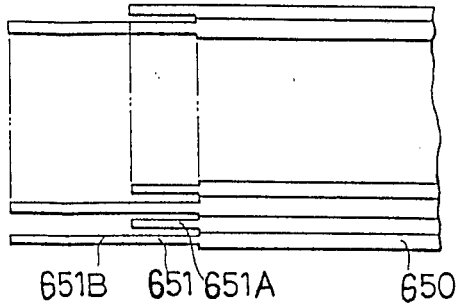
FIG. 28
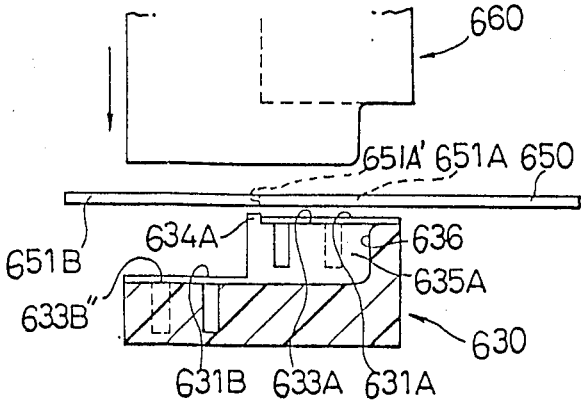
FIG. 29
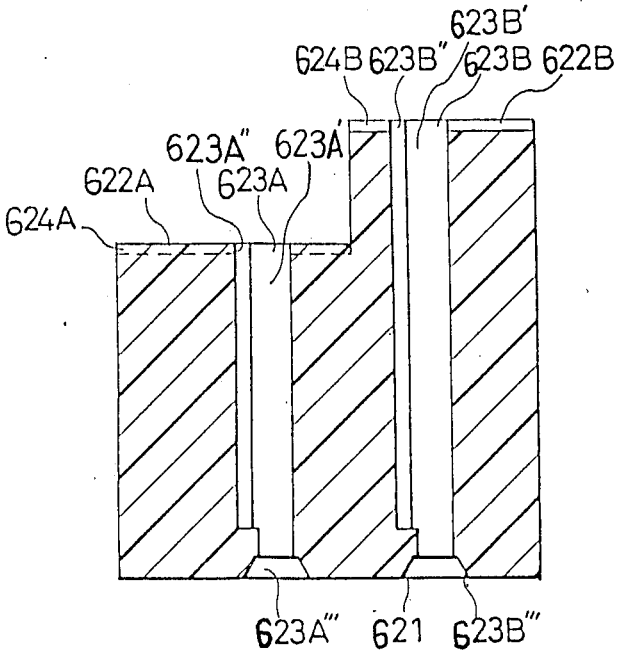
FIG. 27
FIG. 30 A
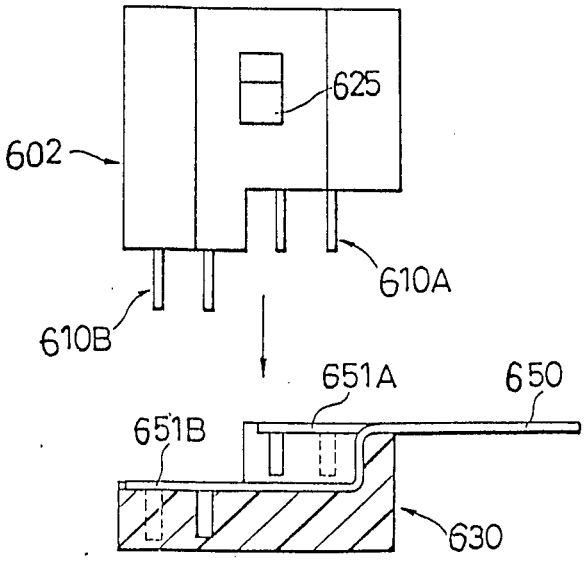
FIG. 30 B

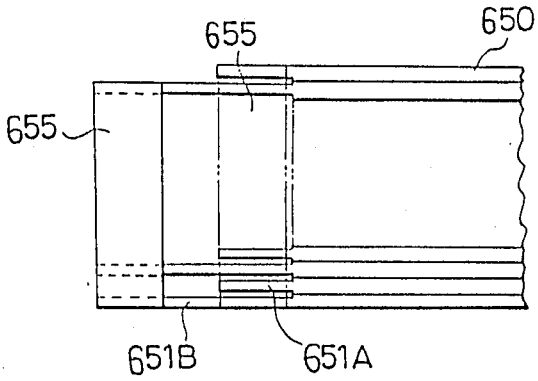
FIG. 31 A
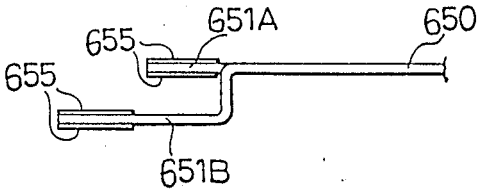
FIG. 31 B
FIG. 32
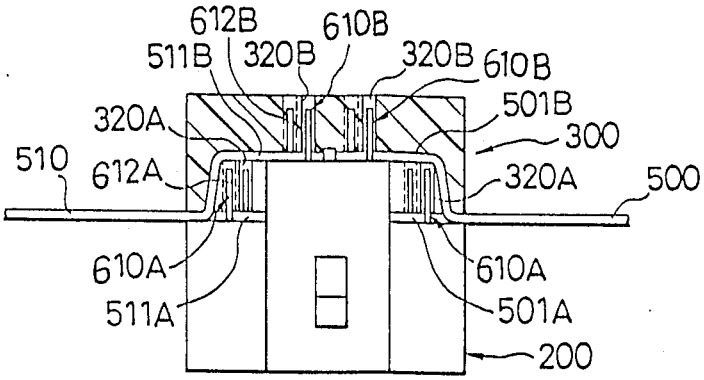
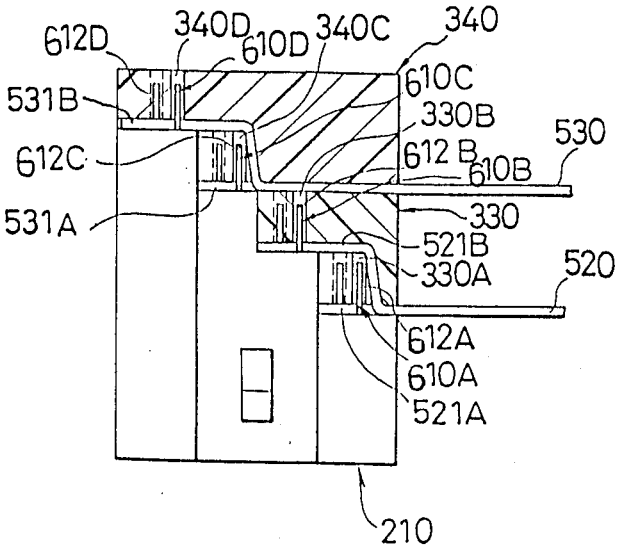
FIG. 33

MULTI-CONDUCTOR FLAT CABLE ELECTRICAL CONNECTOR AND TERMINATION METHOD THERETO

BACKGROUND OF THE INVENTION

1.[Field of the Invention]

The present invention relates to an electrical connector for a multi-conductor flat cable and a termination method thereto.

2.[Description of the Prior Art]

Recently, electronic equipment has become more and more compact than ever before. For this reason, it is desired to mount the parts more densely, and there has been a demand for an electrical connector having terminals arranged more densely for use in compact electronic equipment. There is also a growing demand for a multi-conductor flat cable having a number of conductors arranged densely in a plane for such a small connector. In order to meet such a demand, a multi-conductor flat cable having conductors arranged at a pitch of 0.635 mm (in contrast to the conventional 1.27-mm pitch) has been developed. Japanese Patent Publication Nos. 56-37667 and 57-53629 have proposed a insulation piercing, multi-conductor flat cable connector suitable for the 0.635-mm pitch multi-conductor flat cable. If the respective numbers of conductors and terminals stay the same, the size of the above connector would be one-half the size of the conventional one because the conductor arranging pitch of the cable (0.635 mm) is one-half that of the conventional one (1.27 mm) so that the arrangement pitch of terminals can be made one-half the conventional pitch.

However, the above miniature connector has the following shortcomings:

(1) This electrical connector requires very high process precision. Otherwise, the adjustment between the conductors and the terminals becomes very difficult, thus increasing the final manufacturing cost.

(2) The terminals of this connector must be made smaller and more complicated in shape than before, making their manufacture difficult and thus their manufacturing cost higher.

In order to solve such problems, we have proposed in Japanese Patent Kokai No. 60-167,285 an electrical conenctor to which a plurality of layers of conductors can be pressure welded for dense mounting. However, the multi-conductor flat cable used in the above connector has a pitch of 1.27 mm so that it failed to meet a demand for a smaller and denser electrical connector that is useful for a 0.635-mm pitch multi-conductor flat cable, and reliable, inexpensive, and suitable for volume production.

SUMMARY OF THE INVENTION

Accordingly, it is an object of the present invention to provide a multi-conductor flat cable electrical connector to meet such a demand as set forth above.

Another object of the invention is to provide a method of terminating a multi-conductor flat cable to the above electrical connector.

In accordance with one aspect of the invention there is provided a multi-conductor flat cable electrical connector comprising a plurality of terminals each having a contacting part for contact with the contacting part of a mating connector and a insulation piercing part to be connected to a conductor of a multi-conductor flat cable; an insulating housing for holding said terminals in such a manner that said insulation piercing parts may project upward therefrom; a termination member having a conductor holding recess for an end of said flat cable and adapted to be united to said insulating housing; said terminals being arranged in said insulating housing so that said insulation piercing parts are arranged in at least two pairs of lines; said insulation piercing parts being arranged alternately in each of pairs of said lines at a pitch twice that of said conductors so that the pitch of said terminals may be equal to that of said conductors; said termination member having a pair of conductor arranging recesses extending horizontally to either side from said holding recess and a plurality of insulation piercing part receiving recesses; and said termination member and said insulating housing being united so that said respective conductors are press fitted to said corresponding insulation piercing parts.

According to another aspect of the invention there is provided a multi-conductor flat cable electrical connector including a plurality of terminals each having a contacting part for contact with the contacting part of a mating connector and a insulation piercing part to be connected to a conductor of a multi-conductor flat cable; an insulating housing for holding said terminals; a termination member for holding the end portions of said flat cable and adapted to be united to said insulating housing; said insulating housing having two or more rear surfaces with different distances from the front surface; said insulation piercing parts being arranged alternately in each of two pairs of lines at a pitch twice that of said conductors so that the pitch of the terminals may be equal to that of said conductors; said termination member having two or more front surfaces corresponding to the respective rear surfaces of said insulating housing; said front surfaces of said termination member having a plurality of channels for the conductors separated in two levels and a plurality of recesses for receiving said insulation piercing parts projecting from said insulating housing; and said insulation piercing parts penetrating to the respective conductors of said flat cable when said insulating housing is united to said termination member, with the respective conductors of said flat cable arranged in said channels.

In accordance with still another aspect of the invention there is provided a method of terminating a multi-conductor flat cable to such an electrical connector as described above, which comprises the steps of separating respective end portions of said conductors to either side at a predetermined pitch; placing said separated end portions in said holding recess of said termination member so that the respective end portions may be arranged in said arranging recess; and uniting said insulating housing with said termination member in such a manner that said respective end portions may be press fitted to said corresponding insulation piercing parts of the terminals.

According to yet another aspect of the invention there is provided a method of terminating a multi-conductor flat cable to the above multi-conductor flat cable electrical connector, which comprises the steps of separating respective end portions of said conductors at a predetermined pitch on either side; placing the respective end portions in said channels; and uniting said insulating housing to said termination member in such a manner that said respective end portions may be press fitted to said corresponding insulation piercing parts of the terminals.

Other objects, features, and advantages of the invention will become more apparent from the following description taken in conjunction with the accompanying drawings.

BRIEF DESCRIPTION OF THE DRAWINGS

FIGS. 2A and 2B are elevational and side views of the first type terminals used in the electrical connector of FIG. 1.

FIGS. 3A and 3B are elevational and side views of the second type terminals used in the electrical connector of FIG. 1.

FIG. 4 a rear view of the lower housing section for the electrical connector of FIG. 1.

FIG. 5 is a sectional view taken along the line 5—5 of FIG. 4.

FIG. 6 is a partial rear view of the upper housing section for the electrical connector of FIG. 1.

FIG. 7 is a sectional view taken along the line 7—7 of FIG. 6.

FIG. 8 is a sectional view taken along the line 8—8 of FIG. 6.

FIGS. 9 through 13 illustrate a method of terminating a multi-conductor flat cable to the electrical connector according to the invention.

FIG. 20 shows still another termination method according to the invention.

FIGS. 21 and 22 illustrate an electrical connector according to yet another embodiment of the invention.

FIG. 26 is a rear view of an insulating housing for the electrical connector of FIG. 23.

FIG. 27 is a sectional view of the insulating housing taken along the line 27—27 of FIG. 26.

FIG. 28 is a plan view of the end portion of a flat cable to be connected to the electrical connector of FIG. 23.

FIG. 29 is a side view illustrating how the flat cable is set to the termination member of the electrical connector of FIG. 23.

FIG. 30A is a side view of the insulating block to be connected to the termination member.

FIG. 30B is a sectional view of the termination member to be connected to the insulating block of FIG. 30A.

FIGS. 31A and 31B are plan and side views of the end portions of a flat cable.

FIG. 32 is an elevational view, partially in section, of an electrical connector according to another embodiment of the invention.

FIG. 33 is an elevational view, partially in section, of an electrical connector according to still another embodiment of the invention.

DESCRIPTION OF THE PREFERRED EMBODIMENTS

Figure 1C:
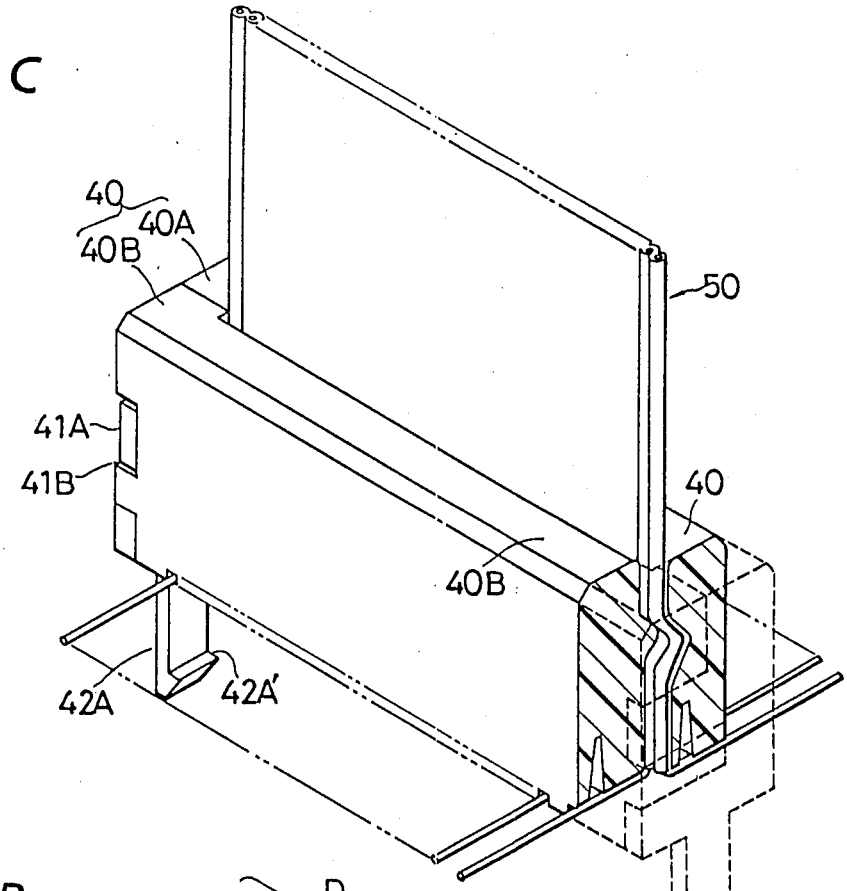
FIG. 1 is an exploded perspective view of a multi-conductor flat cable electrical connector embodying the present invention.
Figure 1B:
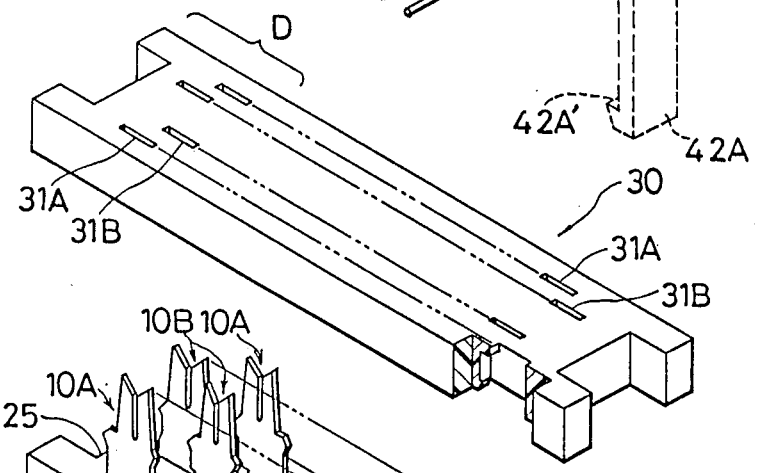

Referring now to FIG. 1 there is shown in an exploded perspective view a multi-conductor flat cable electrical connector embodying the present invention. This connector comprises two types of terminals 10A and 10B, an insulating housing consisting of lower and upper sections 20 and 30 for holding the terminals, and a cable termination member 40 to be connected to the insulating housing. As best shown in FIGS. 2 or 3, each of the terminals 10A or 10B has a contacting part 11A or 11B to be brought into contact with the contacting part of a mating connector and a insulation piercing part 12A or 12B to be connected to each conductor of a multi-conductor flat cable 50. These terminals are held by the insulating housing 20 and 30 in such a manner that their pressure welding parts may be projected from the rear of the housing.

The two types of terminals 10A and 10B are shown in FIGS. 2 and 3 in more detail. As best shown in FIG. 2, the terminal 10A is made of a springy, conductive metal so as to have a contacting part 11A at its lower part, a insulation piercing part 12A at its upper part, and an intermediate part 13A between them. The contacting part 11A has a contacting tongue 11A' for contact with the corresponding contact of a mating connector and a boss 11A'' at each of four corners of the contacting tongue 11A', and a pair of protuberances 11A''' adjacent to the upper bosses. The insulation piercing part 12A has a longitudianal slit 12A' to which a conductor of a flat cable is to be press fitted. The intermediate part 13A has a pair of protuberances 13A' to be inserted into and engaged with a slot 31A of the upper housing section 30 and a stepped portion 13A'' above one of the protuberances 13A'. It is noted that the center line of the insulation piercing part 12A is offset by $\alpha$ from the center line of the contacting part 11A in the same plane. The reason for this offset will be described later.

As best shown in FIG. 3, the other type of contact 10B has the same configuration as that of the above contact 10A except for a curved portion 13B''' in the intermediate part 13B, and therefore its detailed description will be omitted. However, it should be noted that the plane of the insulation piercing part 12B is offset by $\beta$ from the plane of the contacting part 11B.

Figure 1A:
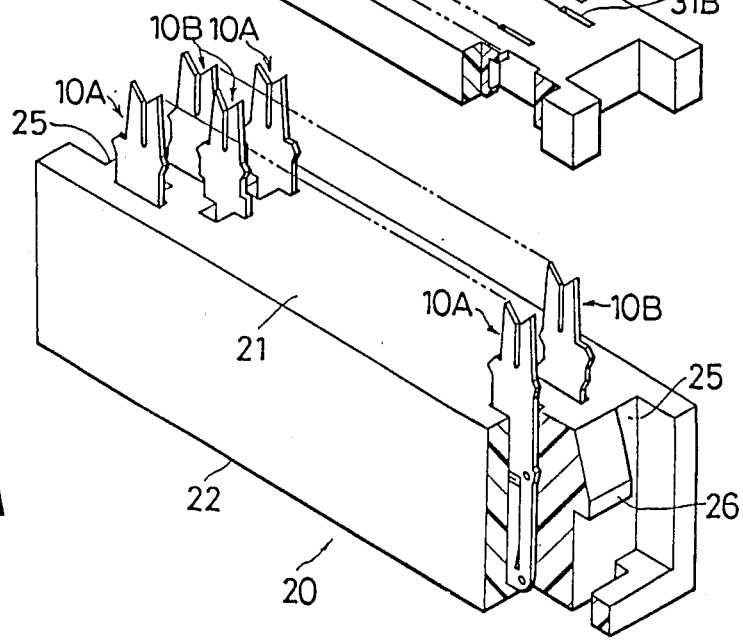

FIGS. 4 and 5 show the rear of the lower insulating housing section 20 and the section taken along the line 5—5 of FIG. 4. The lower housing section 20 is made of an insulating material, such as a plastic, so as to have a rear face 21, a front face 22, and a number of slots 23 across the both faces. These slots are arranged and profiled so as to provide four lines of openings on the rear face 21 and two lines of openings in the front face 22. As best shown in FIGS. 1A, 4 and 5, each slot 23 has a substantially T-shaped section on the rear face 21; i.e., tongue receiving portion 23A or 23B and a plate receiving portion 23A' or 23B' which is in the same plane with the insulation piercing part, and a male contact receiving mouth 23A'' or 23B'' on the front face 22.

As best shown in FIG. 4, the pitch of every other slots 23 arranged alternately in a pair of lines I or II is set twice (1.27 mm) the pitch of conductors of a flat cable (0.636 mm). It is noted that the tongue receiving portions 23A and 23B of the slots 23 are aligned in a single line despite the fact that slots themselves are alternately arranged in two lines A and B of the pair of lines I or II. An assembly of terminals 10A and 10B in the slots 23 are shown in FIG. 1A. Terminals 10A are inserted into slots 23 arranged in the outer line A of the pair of lines I (FIG. 4) in such a manner that their stepped portion 13A'' and contacting tongues 11A' may face to the right and the inside, respectively. Terminals 10B are inserted into slots 23 arranged in the inner line B of the pair of lines I in such a manner that their stepped portion 13B'' and contacting tongues 11B' may face to the right and the outside, respectively. Similarly, terminals 10A are inserted into slots 23 arranged in the outer line A of the pair of lines II in such a manner that their stepped portions 13A'' and contacting tongues 11A' may face to the left and the inside, respectively. Terminals 10B are inserted in slots 23 arranged in the inner line B of the pair of lines II in such a manner that their stepped portions 13B'' and contacting tongues 11B' may face to the left and the inside, respectively.

The center line of insulation piercing part 12A or 12B of the terminal 10A or 10B arranged in the lower housing section 20 is offset by $\alpha$ from the center line of the contact part 12A or 12B. In this embodiment, the value of $\alpha$ is set at 0.3175 mm or one-half of the conductor pitch (0.635 mm) of a flat cable. The lower housing section 20 has on its opposite minor sides a pair of guiding channels 25 in which a pair of latching protuberances 26 are provided for engaging with a pair of latch claws 42A' of the latching legs 42A of a cable termination member 40A to unite the lower and upper housing sections and the cable termination member 40.

As best shown in FIGS. 6, 7, and 8, the upper housing section 30 is made of an insulating material, such as a plastic, in the form of a substantially flat, rectangular plate. It has a plurality of intermediate part receiving slots 31A and 31B through which the terminals 10A and 10B are passed so that their insulation piercing parts 12A and 12B may project therefrom. The intermediate part receiving slots 31A or 31B has on its front side a tapered portion 31A' or 31B' for easy insertion of the terminals 10A or 10B. The slots 23 in the inner line B of the pair of lines I or II each have on the inside a larger tapered portion 31B'' for receiving the curved portion 13B''' of the contact 10B. They also have a stepped portion 31A''' or 31B''' for engaging with the stepped portion 13A'' or 13B'' of a contact 10A or 10B to prevent it from falling off from the upper housing section.

Figure 11:
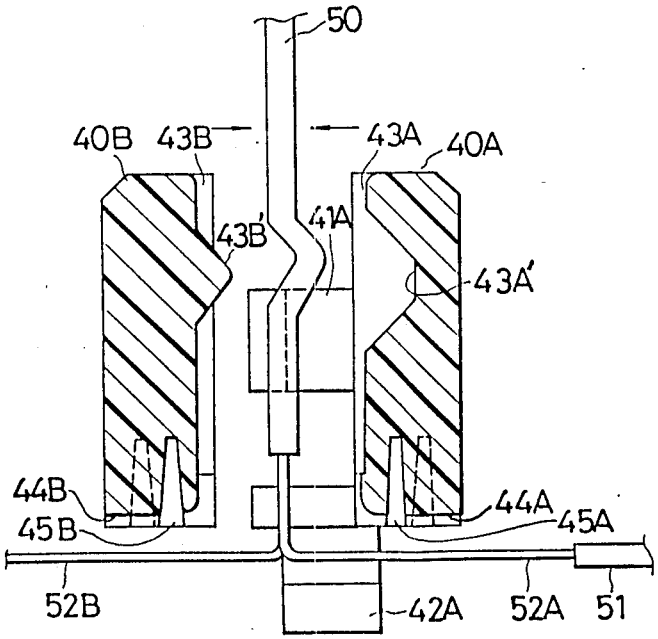

FIGS. 1C and 11 show, the cable termination member 40 consists of a pair of termination member sections 40A and 40B. The termination member section 40A has a pair of latching arms 41A extending forward for engaging with the termination member section 40B (FIG. 1C). It also has a pair of latching legs 42A extending downward and having a latch claws 42A'. The termination member section 40A has a conductor holding recess 43A for cooperating with the termination member section 40B to hold a flat cabe between them. The holding recess 43A has a V-section groove 43A' for preventing the flat cable from pulling off. It also has on its front a conductor arranging recess 44A communicating with the holding recess 43A' and two lines of insulation piercing part hodling recesses 45A for the insulation piercing parts 12A and 12B.

Similarly, the termination member section 40B has a conductor holding recess 43B for cooperating the termination member section 40A to hold a flat cable between them and a V-section protuberance 43B' adapted to be fitted into the groove 43A' for preventing the flat cable from pulling off. It has on its front a conductor arranging recess 44B communicating with the holding recess 43B and two lines of insulation piercing part receiving recesses 45B.

The electrical connector having such a structure as described above may be assembled and connected to a multi-conductor flat cable as follows:

(1) First of all, terminals 10A are inserted into slots 23A in the line A of the pair of lines I on the housing section 20 in such a manner that their contacting tongues 11A' and stepped portion 13A''' may face the inside and the right side, respectively (FIG. 4).

(2) Terminals 10B are inserted into slots 23B in the line B of the pair of lines I in such a manner that their tongues 11B' and stepped portions 13B''' may face the outside and the right side, respectively.

(3) Terminals 10A are inserted into slots 23A in the line A of the pair of lines II on the housing section 20 in such a manner that their contacting tongues 11A' and stepped portion 13A''' may face the inside and the left side, respectively (FIG. 4).

(4) Terminals 10B are inserted into slots 23B in the line B of the pair of lines II in such a manner that their tongues 11B' and stepped portions 13B''' may face the outside and the left side, respectively.

(5) The upper housing section 30 is placed on top of the lower housing section 20 so as to hold the respective intermediate parts 13A and 13B of the terminals 10A and 10B.

(6) As FIG. 9A shows, only the insulating sheaths 51 of a multi-conductor flat cable 50 are cut along the line 51A at a predetermined distance from the cable end.

(7) As FIG. 9B shows, the cut sheaths 51 are moved toward the cable end or in the direction of an arrow to expose the respective conductors 52.

(8) As FIG. 9C shows, every other one of the conductors 52B is cut toward the cable end.

Figure 10:
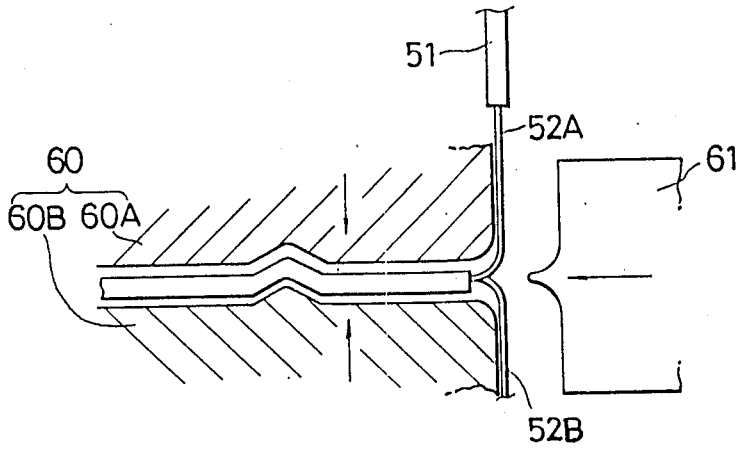

(9) As FIG. 10 shows, the flat cable 50 is placed between a pair of forming dies 60A and 60B so as to form a V-shaped section therein while the exposed conductors 52A and 52B are bent and separated upward and downward, respectively. An arranging die 61 is then pressed against the bent conductors 52A and 52B for both forming and pitching. The forming mold 60 may be replaced by the termination member 40.

(10) As FIG. 11 shows, the formed cable 50 is placed between the termination member sections 40A and 40B for forming a cable-termination member assembly.

Figure 12:
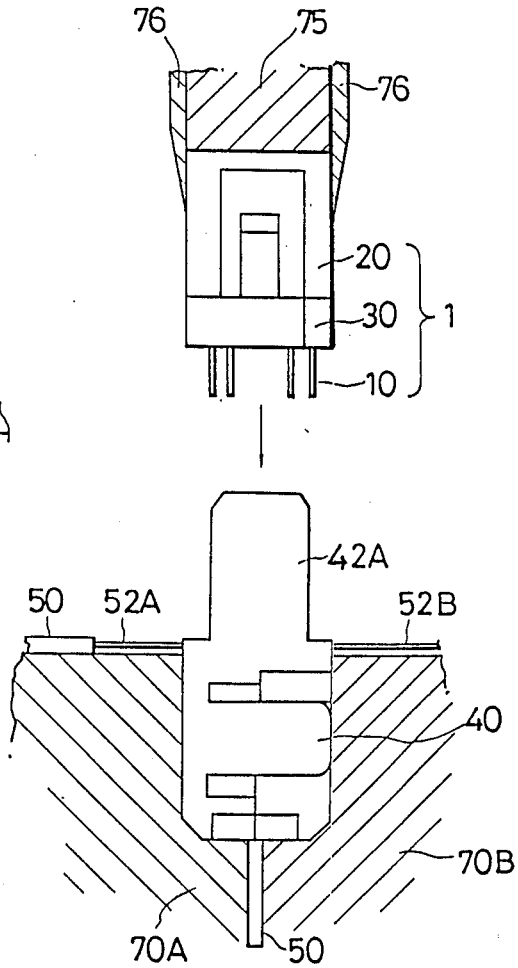

(11) As FIG. 12 shows, the cable-termination member assembly is then placed upside down between a pair of receiving dies 70A and 70B, which are movable horizontally. The connector block 1, which consists of the lower and upper housing sections 20 and 30, and the terminals 10, is joined together with the termination member 40 by means of a press die 75 in such a manner that the insulation piercing parts 12A and 12B of the terminals 10A and 10B may be fitted into the insulation piercing part receiving recesses 45 of the termination member 40 and that the respective conductors 52 of the cable 50 may be press fitted into the respective slits 12A and 12B of the insulation piercing parts 12A and 12B.

Figure 13:
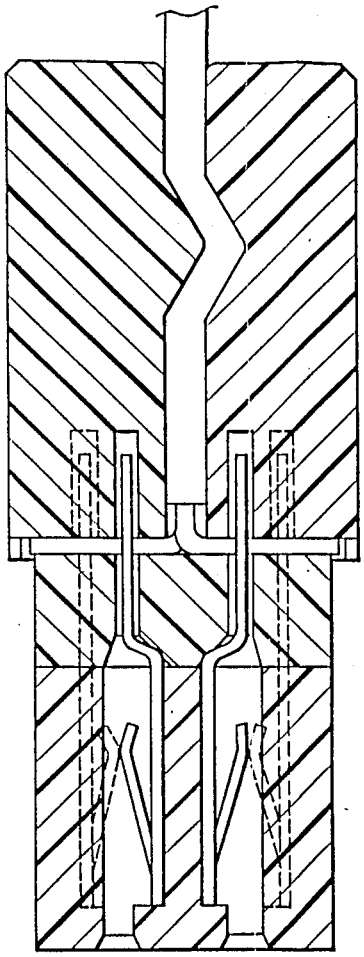

(12) Finally, excess conductors are cut by a pair of conductor cutters 76 disposed opposite sides of the press die 75 to complete the assembly of a connector (FIG. 13).

Figure 14:
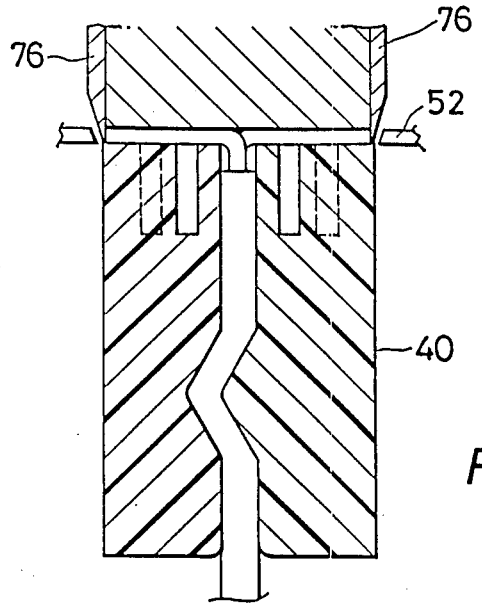
FIG. 14 shows another termination method according to the invention.
Figure 15:
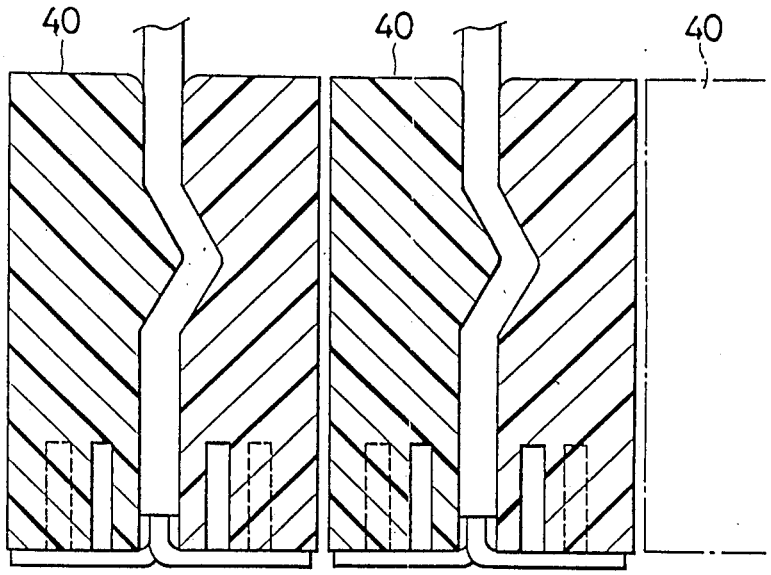
FIG. 15 is a sectional view of several multi-conductor electrical connectors according to the invention.
Figure 15:
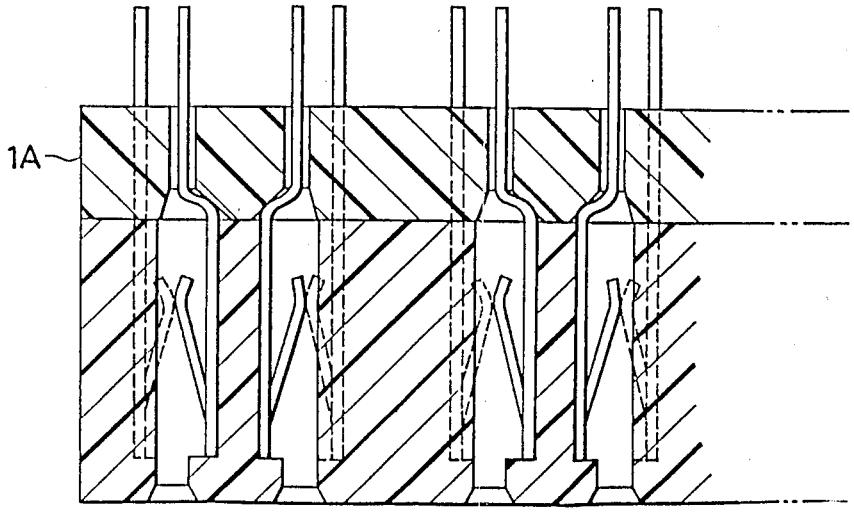

FIGS. 14 and 15 show another embodiment of the invention, in which a connector block 1A has a number of lines of slots 23 for holding terminals 10A and 10B. The number of flat cables 50 is equal to one quarter of the number of contact lines. As FIG. 14 shows, excess conductors 52 are cut by the cutters 76 before the cable termination member 40 is united to the connector block 1A. As FIG. 15 shows, a plurality of such termination members 40 are united to the connector block 1A in such a manner that the terminals 10A and 10B may be fitted into the insulation piercing part receiving recesses 45A and 45B.

Alternatively, the respective conductors of a flat cable may be separated and mounted in the termination member 40 without removing their sheaths.

Figure 16:
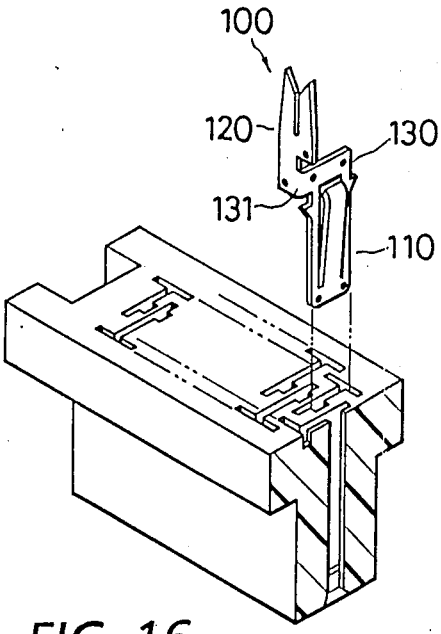
FIG. 16 is a perspective view of the insulating housing of an electrical connector and a contact according to another embodiment of the invention.

FIG. 16 illustrates a still another embodiment of the invention. In the first embodiment illustrated in FIGS. 1 through 8, the terminals have both contacting and insulation piercing parts in the same plane or parallel planes, and the male contact surfaces are arranged in parallel planes in the lengthwise direction of the housing, making the minimum pitch as large as 1.27 mm, thus the arrangement at a pitch of 0.635 mm impossible. The terminals themselves are arranged in the lengthwise direction and, therefore, it is impossible to arrange them at a pitch as small as 0.635 mm. Thus, it is necessary to arrange terminals alternately in two lines at a pitch of 1.27 mm. However, this makes the connector large.

The pitch at which terminals are arranged is desired to be equal to the conductor arranging pitch of the flat cable or 0.635 mm. This is realized by the embodiment of FIG. 16. Like the afore-mentioned terminals 10, the terminals 100 have a contacting part 110, a insulation piercing part 120, and an intermediate part 130. The structures of the contacting part 110 and the insulation piercing part 120 are almost identical with those of the afore-mentioned terminals 10A and 10B and, therefore, their description will be omitted. However, the contact and insulation piercing parts of this embodiment are integral through a bend 131 of the intermediate part 130 in such a manner that the conductor insulation piercing direction of the insulation piercing part 120 may be parallel to the plane of the contact part 110, or the plane of the insulation piercing part 120 may be perpendicular to the plane of the contacting part 110.

In this embodiment there are two types of terminals, in which the lengths of their bend 131 are different. These two types of terminals are arranged in an alternate and reverse fasion so that the insulation piercing parts 120 may be arranged in two pairs of lines or four lines altogether while the contacting parts 110 may be aligned in a sigle straight lne. With this structure, not only the afore-mentioned upper housing section 30 may be omitted but also the width of the insulating housing to be fitted into the mating connector may be reduced.

Figure 17:
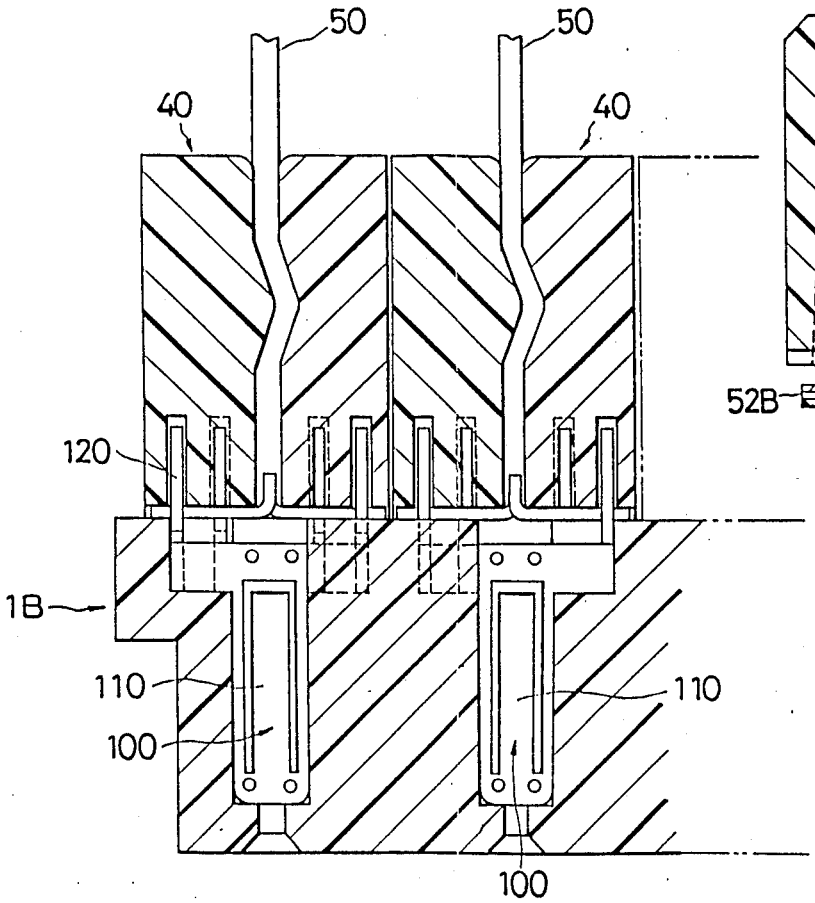
FIG. 17 is a sectional view of an electrical connector according to still another embodiment of the invention.

FIG. 17 shows the arrangement of a plurality of the connectors of FIG. 16. As shown in FIG. 14, a plurality of cable termination members 40 is pushed against a connector block 1B so that the respective insulation piercing parts of the terminals 100 may fitted into the corresponding receiving recesses of the termination members 40.

Figure 18:
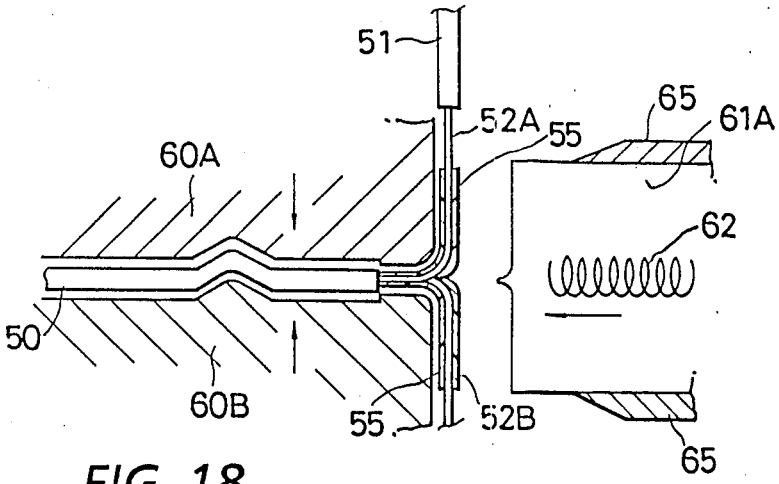
FIGS. 18 and 19 illustrate another termination method according to the invention.
Figure 19:
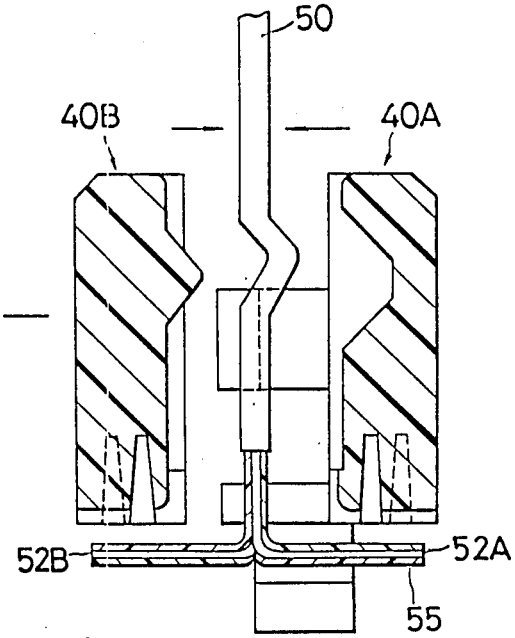

FIGS. 18 and 19 illustrate another method of terminating the end of a multi-conductor flat cable. In the afore-mentioned embodiment, the conductors of a flat cable separated to either side can be difficult to fit in the conductor arranging recess 44 because of pitch disturbance. Thus, in this embodiment, the separated conductor ends are fixed with a fusable tape for preventing pitch change. The early steps of this cable termination process are the same as the steps 1 through 8 of the afore-mentioned process.

(1) Then, as FIG. 18 shows, the flat cable 51 is placed between a pair of forming dies 60A and 60B, and the conductors 52A and 52B are separated extending upward and downward respectively. A pair of fusable tape 55 are provided on opposite sides of the conductors 52A and 52B. These fusable tapes may be provided on one side only.

(2) A conductor arranging die 61A, which has been heated by a heater 62, is pressed against the forming dies 60A and 60B so that the conductors 52A and 52B may be fixed at a predetermined pitch and fused to each other with the fusable tape 55.

(3) The arranging die 61A is removed from the forming dies 60A and 60B while a pair of cutters 65 is moved toward the forming dies 60A and 60B to cut excess conductors 52A and 52B.

(4) As FIG. 19 shows, the flat cable 50 is placed between a pair of termination members 40A and 40B to form a cable-termination member assembly.

(5) This cable-termination member assembly is placed upside down in a pair of receiving dies 70A and 70B as shown in FIG. 12. A connector block 1 is then fitted into the cable termination members 40A and 40B by means of a push die 75 in such a manner that the respective conductors 52 are press fitted into the respective slits 12' of the insulation piercing parts 12 as they are fitted into the receiving recesses 45 of the termination member 40.

FIG. 20 illustrates still another method of terminating the end of a multi-conductor flat cable. There is an occasion where the conductors of a flat cable are to be cross linked to a connector. After the insulating sheaths 51 of a cable 50 are removed toward the end and the conductors 52 are separated, the desired conductors are crossed each other with an insulator placed between them and fixed in place with a fusable tape 55.

FIGS. 21 and 22 show a cable termination member 400 according to another embodiment of the invention. This termination member 400 is composed of a pair of termination member sections 400A and 400B and a retaining member 450 for conductors. The termination member section 400A or 400B has on opposite minor sides a pair of notches 401A or 401B for engaging the respective nails 454 of a pair of arms 453 of the retaining member 450 and on a major lower side a side cut 402A or 402B for receiving a rim 455 of the retaining member 450. The other structural features are identical with those of the afore-mentioned termination members and, therefore, their description will be omitted.

The retaining member 450 has a retaining surface 451 for preventing the conductors 52A and 52B from moving downward. The retaining surface 451 has a plurality of slots 452 through which the insulation piercing parts of terminals pass and two pairs of latching arms 453 with nails 454 engaging with the termination member sections 400A and 400B. It also has a pair of rims 455 along opposite major edges adapted to fit into the side cuts 402A and 402B of the termination member sections 400A and 400B for preventing the conductors 52A and 52B from moving forward.

FIG. 22 illustrates the termination member 400 united to the connector block. This structure makes it easy to assemble the termination member and the connector block because the conductors 52A and 52B are fixed by the retaining surface 450.

According to the above preferred embodiments there are provided the following advantages:

(1) The conductors of a multi-conductor flat cable are separated to either side, mounted in the termination member and press fitted into the connector block so that the conductor arranging pitch of the flat cable can be doubled, thus providing a small-pitch connector as reliable as the conventional large-pitch connector.

(2) A great number of terminals are arranged in a plurality of line, and the center line of pressure welding parts is offset from that of the contacting parts so that the wider contacting parts can be arranged in the lines at equal intervals and their pressure welding parts can be arranged in an alternate fasion, thus providing a smaller connector than ever before.

(3) The terminals for this invention are so large and simple in shape that the manufacturing process is simple, the connection reliability is high, and that the manufacturing cost is low.

(4) A multi-conductor flat cable having a pitch of 0.635 mm, which is one-half the conventional pitch or 1.27 mm, can be terminated to the connector that is smaller than the conventional one.

(5) A great number of terminals are arranged in the connector block and, correspondingly, a number of termination members can be press fitted thereto, thus providing a small connector for a flat cable with a great number of conductors.

(6) As shown in FIG. 1, the inner two lines of terminals are bent toward the outside so that a multi-conductor flat cable can be connected in its lengthwise direction. This vertical connection to the connector makes psossible a dense mounting of a plurality of connectors side by side.

(7) As shown in FIG. 16, the contacting parts are aligned in a single line while the insulation piercing parts are arranged in four lines so that the connector can be further miniaturized, thus making it possible to terminate a very small pitch cable at high density.

(8) As shown in FIG. 9, the insulating sheaths of a flat cable are utilized as positioning members until the termination is completed, thus simplifying the termination operation.

Figure 23:
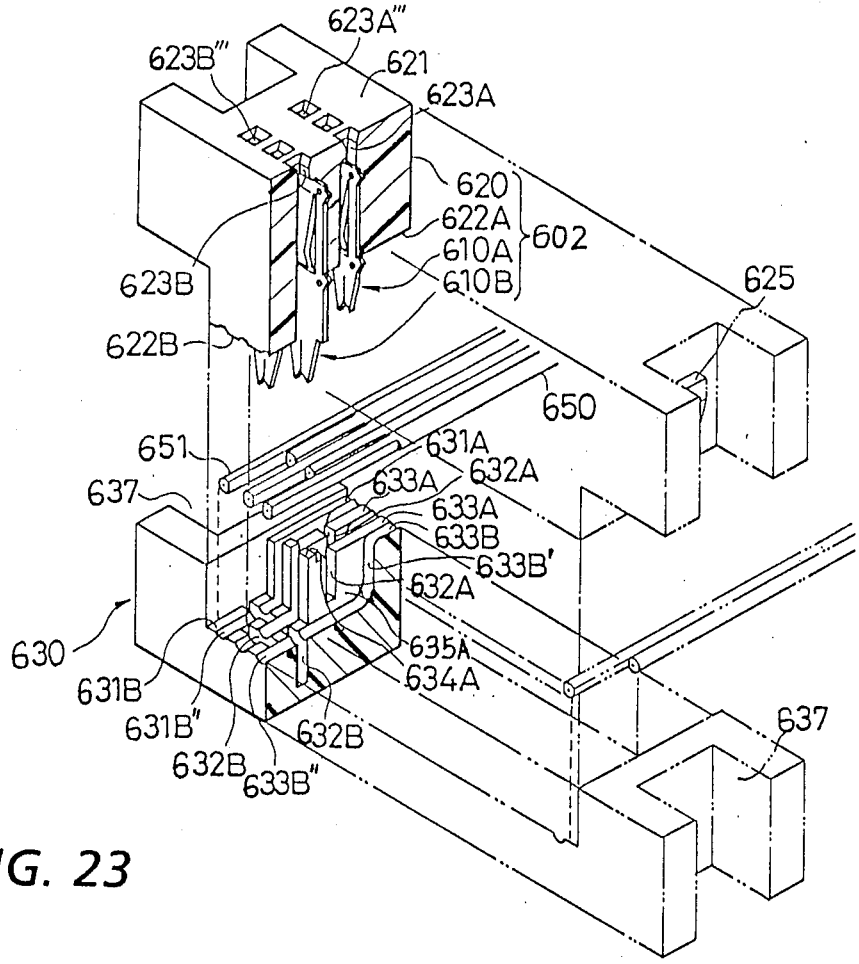
FIG. 23 is an exploded perspective view of a multi-conductor flat cable electrical connector embodying the present invention.

Referring now to FIG. 23 there is shown in an exploded perspective view a multi-conductor flat cable electrical connector embodying the present invention. This connector comprises two types of female terminals 610A and 610B, an insulating housing 620 for holding the terminals, and a cable termination member 630 for holding the insulation piercing parts of the female terminals 610A and 610B and the conductors 651 of a flat cable 650.

Figure 24:
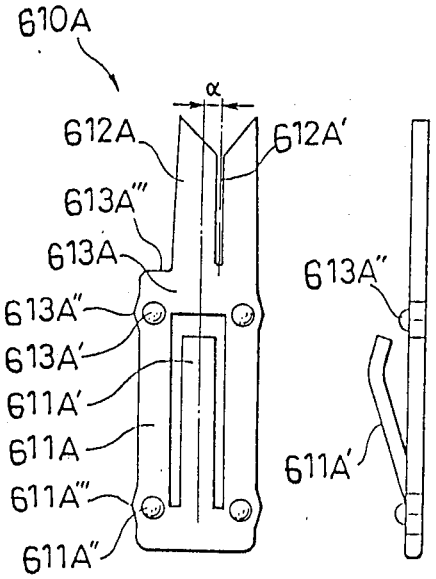
FIGS. 24A and 24B are elevational and side views of a shorter contact used in the electrical connector of FIG. 23.
Figure 25:
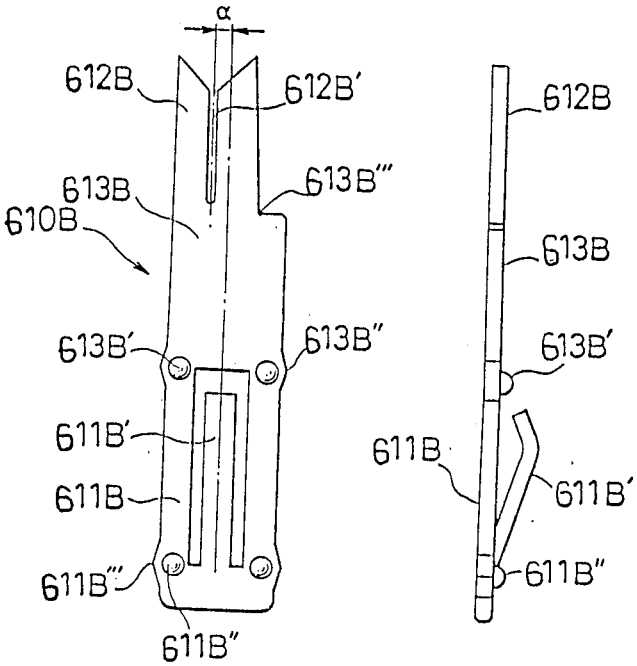
FIGS. 25A and 25B are elevational and side views of a longer contact used in the electrical connector of FIG. 23.

The two types of terminals 610A and 610B are shown in FIGS. 24 and 25 in more detail. As best shown in FIG. 24, the female terminal 610A is made of a springy, conductive metal so as to have a contacting part 611A at its lower part, a insulation piercing part 612A at its upper part, and a short intermediate part 613A between them. The contacting part 611A has a contacting tongue 611A' for contact with the corresponding contact of a mating connector and a pair of bosses 611A'' at opposite lower corners of the contacting tongue 611A', with a pair of protuberances 11A''' adjacent to the lower bosses. The insulation piercing part 612A has a longitudinal slit 612A' to which a conductor of a flat cable is to be pressure welded. The intermediate part 613A has a pair of bosses 613A' to be inserted into and engaged with a recess 632A of the termination member 630 for preventing the contact from rattling. It also has a pair of protrerances 613A'' for engaging with the recess 632A and a stepped portion 613A'' above one of the protuberances 613A''. It is noted that the center line of the insulation piercing part 612A is offset by $\alpha$ from the center line of the contacting part 611A in the same plane. The reason for this offset will be described later.

As best shown in FIG. 25, the other type of female terminal 610B has the same configuration as that of the above terminal 610A except that its intermediate part 613B is longer than the intermediate part 613A and, therefore, its detailed description will be omitted.

FIGS. 26 and 27 show the rear and the section of part of the insulating housing 620. The insulating housing 620 is made of an insulating material, such as a plastic, so as to have a front surface 621, a first rear surface 622A and a second rear surface 622B, and a number of slots 623A and 623B across the front and rear surfaces. These slots have substantially square mouths 623A''' and 623B''' arranged in a pair of lines on the front surface for receiving male terminals and substantially T-shaped sections arranged in two pairs of lines on the rear surface 622. The first pair of slots 623A are arranged in an alternate and facing fasion so that their contacting tongues 623A' may be aligned in a single straight line while their flat portions 623A''0 may be alined in the pair of lines. Similarly, the second pair of slots 623B have contacting tongue receiving portions 623B' and flat portion 623B''.

As best shown in FIG. 26, the first or lower rear surface 622A has a plurality of channels 624A for receiving every other conductors 651 of a flat cable 650 at a pitch set twice (1.27 mm) the pitch of conductors of the flat cable (0.635 mm). Similarly, the second or higher rear surface 622B has a plurality of conductor receiving channels 624B. The female terminals 610A are inserted into the slots 623A in such a manner that their contacting tongues 611A' may be placed in the tongue receiving portions 623A' and that the slits 612A' may be alined with the conductor receiving channels 624A. Similarly, the female terminals 610B are inserted into the slots 623B to complete the assembly of an insulating block 602.

As best shown in FIGS. 24 or 25, the center line of the insulation piercing part 612A or 612B is offset by $\alpha$ from the center line of the contacting part 611A or 611B. In this embodiment, the value of $\alpha$ is set at one-half the conductor arranging pitch of the flat cable ($\frac{1}{2}\times 0.635$ mm$=0.3175$ mm). Consequently, the distance between the center line of the insulation piercing part 612A of the female contact 610A in the first rear surface 622A and the center line of the adjacent insulation piercing part 612B in the second rear surface 622B is equal to the conductor arranging pitch of the flat cable or 0.635 mm (FIG. 26). Thus, the pressure welding parts 612A and 612B of the inuslting block 602 are arranged at the same pitch as that of the flat cable. The insulating housing 620 has on opposite sides a pair of latching protuberances 625 for engagement with the latching means (not shown) of the termination member 630.

As FIG. 23 shows, the termination member 630 is made of an insulating material, such as a plastic, to have a first front surface 631A corresponding to the first rear surface 622A of the insulating housing 620 and a second front surface 631B corresponding to the second rear surface 622B. The first or higher front surface 631A has a plurality of recesses 32A arranged alternately in a pair of lines for receiving the corresponding insulation piercing parts 612A of female terminals 610A. It also has first and second channels 633A and 633B for receiving the conductors 651 of the flat cable 650. The first or shorter channels 633A are provided to support a first set of shorter conductors 651 above the slots 632A while the second or longer channels 633B are for supporting a second set of longer conductors 651 above the recesses 632B on the second front surface 631B. A plurality of stoppers 634A are provided at the respective front ends of the first channels 633A to abut against the respective free ends 651A' of the first set of conductor 651. A plurality of walls 635A with the recess 632A are provided to hold therebetween the second set of conductors 51 extending to the second channel ends 633B'' (see FIG. 29).

The slots 632B are arranged alterntely in a pair of lines for receiving the corresponding pressure parts 612B of the female terminal 610B held in the insulating housing 620. A plurality of second channel ends 633B'' are porivided on the second front surface 621B for receiving the second set of conductors 651. The second channel end communicates with the second channel 633B on the first front surface 631A and the second channel 633B' on the vertical surface 636. The termination member 630 has on opposite sides a pair of channels 637 for receiving a pair of latching means (not shown) to unite to the insulating housing 620.

The electrical connector having such a structure as described above may be assembled and connected to a multi-conductor flat cable as follows:

(1) First of all, female terminals 610A are inserted into slots 623A on the first rear surface 622A of the insulating housing 620 in such a manner that their contacting tongues 611A' may be placed in the tongue receiving portions 623A'.

(2) Similarly, female terminals 610B are inserted into slots 623B on the second rear surface 622B of the insulating housing 620.

(3) As FIG. 28 shows, the shorter and longer conductor end poritons 651A and 651B of a flat cable 650 are separated.

(4) As FIG. 29 shows, the terminated flat cable 650 is placed on top of the termination member 630 so that the shorter and longer conductor end portions 651A and 651B may be on top of the first and second channels 633A, and 633B, 633B' and 633B'', respectively. The conductors 651A and 651B are then fitted in the first and second channels 633A and 633B by means of a pushing tool (see FIG. 30B).

(5) As FIG. 30A shows, the terminals 610A and 610B of the block 602 are pushed into the respective recesses of the termination member 630.

(6) Finally, the insulating housing 620 and the termination member 630 are united and locked with a pair of latching means (not shown).

FIGS. 31A and 31B are plan and side views of the conductor end portions of a flat cable 650 terminated by another method according to the invention. In this embodiment, the conductors 651A and 651B are fixed with fusable tapes 655 for the prevention of conductor pitch change, thus facilitating the assembly of conductors in the termination member.

FIG. 32 shows an electrical connector according to another embodiment of the invention. An insulating housing 200 has four pairs of rows of slots; the outer two pairs of rows of slots hold shorter female terminals 610A and the inner two pairs of rows of slots hold longer female terminals 10B. A termination member 300 has two pairs of rows of recesses 320A for receiving the insulation piercing parts 612A projecting from the insulating housing 200. When press fitted into the recesses, the insulation piercing parts 612A are connected to the respective shorter conductors 501A and 511A of a pair of flat cables 500 and 510. The termination member 300 also has two pairs of inner rows of recesses 320B for receiving the insulation piercing parts 232A projecting from the insulating housing 200. When press fitted into the recesses, the insulation piercing parts 232A are connected to the longer conductors 501B and 511B of the flat cables 500 and 510. In this way, a pair of flat cables can be terminated to an insulating block on opposite sides.

FIG. 33 shows an electrical connector according to still another embodiment of the invention. Four types of female terminals 610A, 610B, 610C, and 610D, which are different in length, are placed in the stepped front surfaces of an insulating housing 210 in such a manner that their insulating piercing parts 612A, 612B, 612C, and 612D may project from the respective front surfaces so that when upper and lower termination members 340 and 330 are press fitted over the insulating housing, the insulation piercing parts may be connected to the conductors of a pair of flat cables 530 and 520. The lower termination member 330 has two pairs of rows of recesses 330A and 330B for receiving the insulation piercing parts 612A and 612B of terminals 610A and 610B which project from the front surfaces of the insulating housing 210. The upper termination member 340 has two pairs of rows of recesses 340C and 340D for receiving the insulation piercing parts 612C and 612D of terminals 610C and 610D which project from the front surfaces of the insulating housing 210. Consequently, the respective conductors 521A and 521B of the flat cable 520 are connected to the respective insulation piercing parts 612A and 612B while the respective conductors 531A and 531B of the flat cable 530 to the respective insulation piercing parts 612C and 612D. Thus, a pair of flat cables can be terminated one upon another on one side of the insulating block. It is noted that the embodiments of FIGS. 32 and 33 may be combined so that a larger number of flat cables can be terminated to an insulating block.

Figure 34:
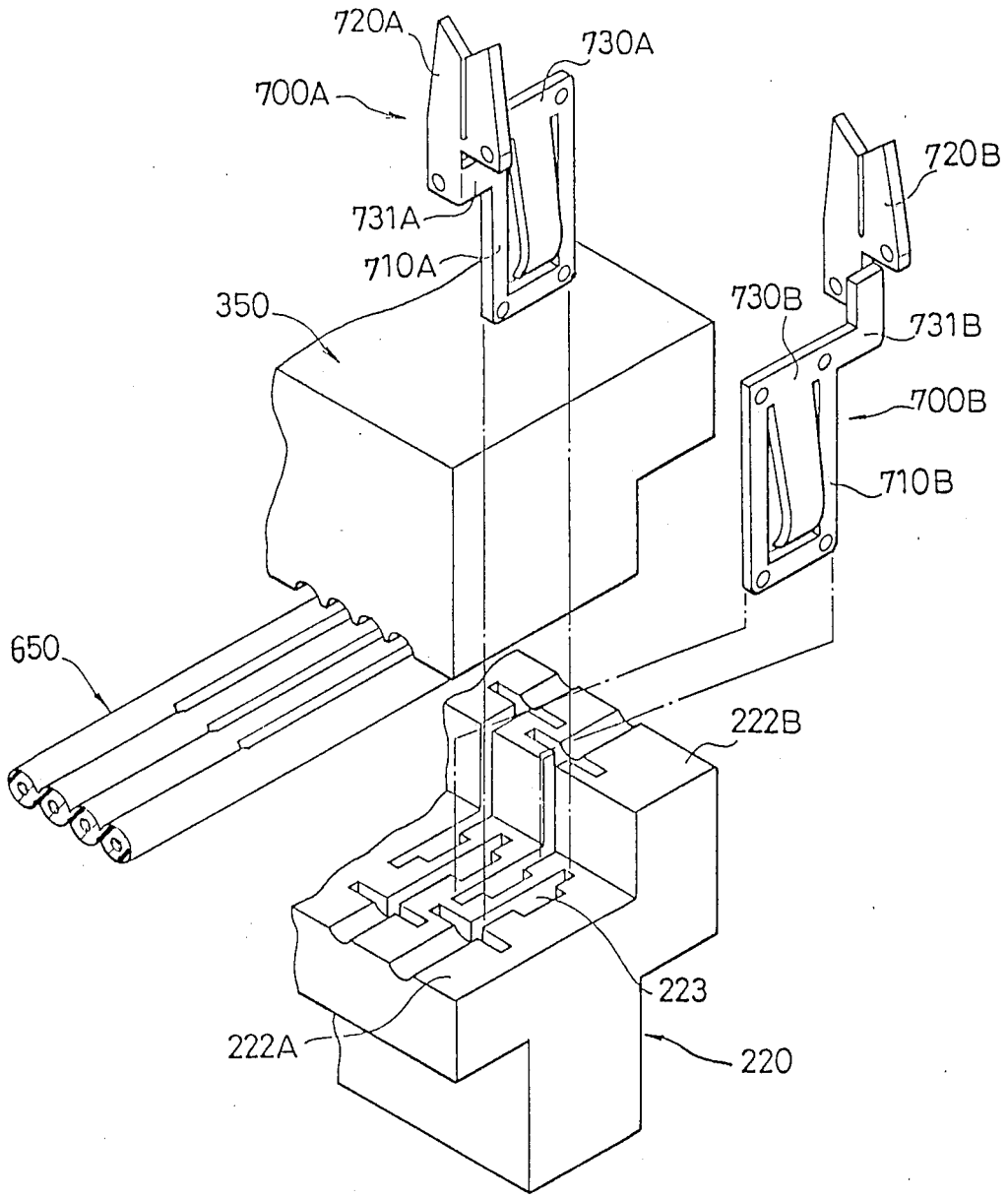
FIG. 34 is an exploded perspective view of an electrical connector according to yet another embodiment of the invention.

FIG. 34 is an exploded perspective view of a connector according to yet another embodiment of the invention. In all the above embodiments illustrated in FIGS. 23 through 33, the insulation piercing parts and the contacting parts are made in the same plane so that the pitch of adjacent female terminals is determined by the maximum width or the width of the contacting parts of the female terminals. More specifically, the minimum pitch of adjacent female terminals is determined by the sum of the maximum width of the contacting part and the width of the insulating wall between the adjacent slots. Since the maximum width of the contacting parts is large, the slots must be arranged alternately in a pair of lines for a small or 0.635-mm pitch flat cable. However, it is desired that the slots are arranged in a single straight line at the same pitch as that of the flat cable thereby further reducing the connector size.

As FIG. 34 shows, like the afore-mentioned contact 610A, a contact 700A has a contacting part 710A, a insulation piercing part 720A, and an intermediate part 730A. The contacting and insulation piercing parts 710A dn 720A are the same as those of the terminal 610A, and their detailed description will be omitted. The contacting part 710A, however, is integral with the insulation piercing part 720A through a bent portion 731A of the intermediate part 730A in such a manner that the plane of the insulation piercing part is substantially perpendicular to that of the contacting part. The other structural features of the intermediate part are the same as those of the afore-mentioned terminal 610A and, thereore, their detailed description will be omitted. There are two types of terminals 700A with the bent portions 731A having different lengths. These two types of terminals are alternately arrnged in the slots 223 on rear surface 222A in such a manner that their insulation piercing parts 720A may be arranged alternately in a pair of lines on the rear surfaces 222A.

Similarly, the terminals 700B has a contacting part 710B, a insulation piercing part 720B, and an intermediate part 730B. The contacting and insulation piercing parts 710B and 720B are the same as those of the contact 610B, and their detailed description will be omitted. The contacting part 710B, however, is integral with the insulation piercing part 720B through a bent portion 731B of the intermediate part 730B in such a manner that the plane of the insulation piercing part is substantially perpendicular to that of the contacting part. The other structural features of the intermediate part 730B are the same as those of the afore-mentioned contact 610A and, therefore, their detailed description will be omitted. There are two types of terminals 700B with the bent portions 731B of having different lengths. These two type of terminals are alternately arrnged in the slots 223 on the rear surface 222A in such a manner that their insulation piercing parts 720B may be arranged alternately in a pair of lines on a second rear surface 222B. As a result, the insulation piercing parts 720A and 720B of terminals 700A and 700B are arranged in two pairs of lines on the insulating housing 220, with the contacting parts 710A and 710B arranged in a single line. This structure reduces the width of the insulating housing to be inserted into the mating connector. The termination member 350 is substantially identical with the termination member 630 and, therefore, its detailed description will be omitted.

Those embodiments of the invention have the following advantages:

(1) The respective conductors of a multi-conductor flat cable are separated to either side, mounted in the termination member and press fitted into the connector block so that the conductor arranging pitch of the flat cable can be doubled, thus providing a small-pitch connector as reliable as the conventional large-pitch connector.

(2) The terminals for this invention are so large and simple in shape that they can be manufactured by a simple process with high connection reliability at low manufacturing cost.

(3) The respective conductors of a flat cable are connected to the connector block at substantially right angles so that the height of the connector is sufficiently low to provide a very compact connector.

(4) The terminals, insulating housing, and cable termination member are so simple in form and so easy to assemble, and the number of parts is so small that the termination mehtod is simple and easy. Accordingly, they are suited to volume production, thus providing a large number of inexpensive connectors for miniature flat cables.

(5) A multi-conductor flat cable having a pitch of 0.635 mm, which is one-half the conventional pitch or 1.27 mm, can be terminated to the connector at the same pitch as the conventional one by the substantially same termination method as the conventional one, thereby providing an inexpensive yet reliable termination method.

While preferred embodiments of the invention have been described above using specific terms, such description is for illustrative purpose only, and it is to be understood that changes and variations may be made without departing from the spirit and scope of the invention as set forth in the following cliams.

What is claimed is:

1. A multi-conductor flat cable electrical connector, which comprises:

a plurality of terminals each having a contacting part to contact with a contacting part of a mating connector and an insulation piercing part to be connected to a conductor of a multi-conductor flat cable;

an insulating housing for holding said terminals in such a manner that said insulation piercing parts may project therefrom;

a termination member having a conductor holding recess for an end of said flat cable and adapted to be united to said insulating housing;

said terminals being arranged in said insulating housing so that said insulation piercing parts may be aligned in at least two pairs of lines;

said insulation piercing parts being arranged alternately in each of said pairs of lines at a pitch twice that of said conductors so that the pitch between said adjacent terminals may be equal to that of said conductors;

said termination member having a pair of conductor arranging recesses extending laterally to either side from said holding recess and a plurality of insulation piercing part receiving recesses; and said terminatioin member and said insulating housing being united so that said respective conductors are press fitted to said respective insulation piercing parts.

2. A multi-conductor flat cable electrical connector according to claim 1, wherein said insulating housing consists of a pair of first and second housing sections, said second housing section being placed atop said first housing section for assuring the holding of said terminals in said first housing section.

3. A multi-conductor flat cable electrical connector according to claim 1, wherein said insulating housing is made integral as a unit.

4. A multi-conductor flat cable electrical connector according to claim 1, wherein said insulation piercing parts are arranged alternately in each of said pairs of lines while said contacting parts are aligned in a pair of lines.

5. A multi-conductor flat cable electrical connector according to claim 4, wherein said terminals consist of first and second type of terminals, said first type terminals each having a insulation piercing part and a contacting part in the same plane, the center line of said insulation piercing parts being offset by a distance equal to said conductor arranging pitch from the center line of said contacting parts in the same plane, said second type terminals each having a insulation piercing part and a contacting part in different parallel planes, the center line of said insulation piercing parts being offset by a distance equal to said conductor arranging pitch from the center line of said contacting parts in the plane, an inside pair of said two pairs of lines of terminals being of the second type while an outside pair of said terminals being of the first type.

6. A multi-conductor flat cable electrical connector according to claim 1, wherein said insulation piercing parts are arranged alternately in each of said two pairs of terminals while said contacting parts are arranged in a single line.

7. A multi-conductor flat cable electrical connector according to claim 6, wherein said terminals consists of first and second types of terminals, said first type terminals each having a insulating piercing part and a contacting part, the plane of said insulation piercing part being perpendicular to the plane of said contacting part and being offset by a first predetermined distance from the center line of said contacting part, said second type terminals each having a insulation piercing part and a contacting part, the plane of said insulation piercing part being perpendicular to that of said contacting part and being offset by a second distance, which is greater than said first distance, from the center line of said contacting part, an inside pair of lines of said insulation piercing parts being of the first type terminals while an outside pair of lines of said insulation piercing parts being of the second type terminals.

8. A multi-conductor flat cable electrical connector according to claim 1, wherein said termination member consisting of first and second termination member sections, each having a holding recess so as to form a holding slot when they are united.

9. A multi-conductor flat cable electrical connector according to claim 1, wherein said termination member has a conductor retaining member for covering the mouth of said holding slot.

10. A multi-conductor flat cable electrical connector, which comprises:

a plurality of terminals each having a contacting part for contact with the contacting part of a mating connector and a insulation piercing part to be connected to a conductor of a multi-conductor flat cable;

an insulating housing for holding said terminals;

a termination member for holding the end portions of said flat cable and adapted to be united to said insulating housing;

said insulating housing having at least two rear surfaces with different depths from the front surface;

said insulation piercing parts being arranged alternately in each of two pairs of lines at a pitch twice that of said conductors so that the pitch between said adjacent terminals is equal to that of said conductors;

said termination member having at least two front surfaces corresponding to the respective rear surfaces of said insulating housing;

said front surfaces of said termination member having a plurality of channels for the conductors separated in two levels and a plurality of recesses for receiving said insulation piercing parts projecting from said insulating housing; and said insulation piercing parts being pressure welded to the respective conductors of said flat cable when said insulating housing is united to said termination member, with the respective conductors of said flat cable arranged in said channels.

11. A multi-conductor flat cable electrical connector according to claim 10, wherein said insulator piercing parts are arranged alternately in each of said two pairs of lines while said contacting parts are arranged in a pair of lines.

12. A multi-conductor flat cable electrical connector according to claim 10, wherein said terminals consist of first and second types of terminals, said first type terminals each having a insulation piercing part and a contacting part in the same plane, the center line of said insulation piercing parts being offset by a distance equal to the pitch of said conductors from the center line of said contacting parts;

said second type terminals each having a insulation piercing part and a contacting part in the same plane, the center line of said insulation piercing parts being offset by a distance equal to the pitch of said conductor from the center line of said contacting parts, the length of said intermediate parts is greater than that of said first type of terminals.

13. A multi-conductor flat cable electrical connector according to claim 10, wherein said insulation piercing parts are arranged alternately in each of said two pairs of lines while said contacting parts are arranged in a single line.

14. A multi-conductor flat cable electrical connector according to claim 10, wherein said terminals consists of first, second, third, and fourth types of terminals, said first type terminals each having a insulation piercing part and a contacting part, the plane of said insulation piercing part being perpendicular to the plane of said contacting part and being offset by a first predetermined distance from the center line of said contacting part, said second type terminals each having a insulation piercing part and a contacting part, the plane of said insulation piercing part being perpendicular to that of said contacting part and being offset by a second distance, which is greater than said first distance, from the center line of said contacting part, and the height of said insulation piercing parts is the same as that of said first terminals;

said third type terminals each having a insulation piercing part and a contacting part, the plane of said insulation piercing part being perpendicular to the plane of said contacting part and being offset by a third predetermined distance from the center line of said contacting part, said fourth type terminals each having a insulation piercing part and a contacting part, the plane of said insulation piercing part being perpendicular to that of said contacting part and being offset by a fourth distance, which is greater than said first distance, from the center line of said contacting part, and the height of said insulation piercing parts is the same as that of said third terminals but larger than that of said first and second terminals;

said first and second terminals being alternately arranged on said lower front surface of said insulating housing while said third and fourth terminals are alternately arranged on said higher front surface of said insulating housing.

15. A method of terminating a multi-conductor flat cable to a multi-conductor flat cable electrical connector including a plurality of terminals each having a contacting part for contact with the contacting part of a mating connector and a insulation piercing part to be connected to a conductor of a multi-conductor flat cable; an insulating housing for holding said terminals in such a manner that said insulation piercing parts may project therefrom; a termination member having a conductor holding recess for an end of said flat cable and adapted to be united with said insulating housing; said terminals being arranged in said insulating housing so that said insulation piercing parts are arranged in at least two pairs of lines; said insulation piercing parts being arranged alternately in each of pairs of said lines at a pitch twice that of said conductors so that the pitch between said adjacent terminals may be equal to that of said conductors; said termination member having a pair of conductor arranging recesses extending laterally to either side from said holding recess and a plurality of insulation piercing part receiving recesses; and said termination member and said insulating housing being united so that said respective conductors are press welded to said respective insulation piercing parts, which comprises the steps of:

separating respective end portions of said conductors to either side at a predetermined pitch;

placing said separated end portions in said holding recess of said termination member so that the respective end portions may be arranged in said arranging recess; and uniting said insulating housing to said termination member in such a manner that said respective end portions may be press fitted to said corresponding insulation piercing parts of the terminals.

16. A termination method according to claim 15, wherein said separating step is performed while said conductors each still have an insulating sheath.

17. A termination method according to claim 15, wherein said separating step is made by cutting only the insulating sheath of each of said conductors at a predetermined distance from an end of said flat cable; moving said cut sheaths toward said cable end to expose said respective conductors; cutting every other one of said exposed conductors toward said cable end; and separating said cut wires and said uncut wires with their sheaths to opposite sides.

18. A termination method according to claim 15, wherein said uncut conductors with their sheath are cut at their end after said uniting step.

19. A termination method according to claim 15, wherein said separating step is followed by fixing said separated conductors with a fusable tape for preventing any pitch change and then cutting said uncut conductors at their end.

20. A termination method according to claim 15, wherein said separating step is made while crossing said respective conductors.

21. A termination method according to claim 15, wherein said separating step is made while crossing said respective conductors with an insulator present between them.

22. A method of terminating a multi-conductor flat cable to a multi-conductor flat cable electrical connector including a plurality of terminals each having a contacting part for contact with the contacting part of a mating connector and a insulation piercing part to be connected to a conductor of a multi-conductor flat cable; an insulating housing for holding said terminals; a terminating member for holding the end portions of said flat cable and adapted to be united to said insulating housing; said insulating housing having two or more rear surfaces with different depths from the front surface; said insulation piercing parts being arranged alternately in each of two pairs of lines at a pitch twice that of said conductors so that the pitch between said adjacent terminals may be equal to that of said conductors; said terminating member having two or more front surfaces corresponding to the respective rear surfaces of said insulating housing; said front surfaces of said terminating member having a plurality of channels for the conductors separated in two levels and a plurality of recesses for receiving said insulation piercing parts projecting from said insulating housing; and said insulation piercing parts being press fitted to the respective conductors of said flat cable when said insulating housing is united to said terminating member, with the respecitive conductors of said flat cable arranged in said channels, which comprises the steps of:

separating respective end portions of said conductors at a predetermined pitch on either side;

placing the respective end portions in said channels; and uniting said insulating housing to said terminating member in such a manner that said respective end portions may be press fitted to said corresponding insulation piercing parts of the terminals.

23. A terminating method according to claim 22, wherein said separated conductors are fixed together with a fusable tape so as to prevent any pitch change.

* * * * *